US007410010B2

(12) United States Patent
Henriksson et al.

(10) Patent No.: US 7,410,010 B2
(45) Date of Patent: Aug. 12, 2008

(54) HYDRAULIC IMPACT MECHANISM

(75) Inventors: Roland Stig Henriksson, Nacka (SE); Anders Wilhelm Lundgren, Degerhamn (SE)

(73) Assignee: Atlas Copco Construction Tools AB, Nacka (SE)

( * ) Notice: Subject to any disclaimer, the term of this patent is extended or adjusted under 35 U.S.C. 154(b) by 0 days.

(21) Appl. No.: 11/660,974

(22) PCT Filed: Aug. 24, 2005

(86) PCT No.: PCT/SE2005/001230

§ 371 (c)(1),
(2), (4) Date: Jun. 20, 2007

(87) PCT Pub. No.: WO2006/022584

PCT Pub. Date: Mar. 2, 2006

(65) Prior Publication Data

US 2007/0251731 A1 Nov. 1, 2007

(30) Foreign Application Priority Data

Aug. 25, 2004 (SE) ..... 0402067

(51) Int. Cl.
*E21B 1/00* (2006.01)
*B25D 9/16* (2006.01)

(52) U.S. Cl. ..... 173/208; 173/90; 173/128; 173/135; 173/206; 91/300; 91/321

(58) Field of Classification Search ..... 173/90, 173/91, 206, 207, 208, 135, 138, 128, 212; 175/51, 296, 98, 230; 91/300, 321, 246
See application file for complete search history.

(56) References Cited

U.S. PATENT DOCUMENTS

| | | | | | |
|---|---|---|---|---|---|
| 3,774,502 | A | * | 11/1973 | Arndt | 91/246 |
| 4,460,051 | A | * | 7/1984 | Widmer | 173/208 |
| 4,474,248 | A | * | 10/1984 | Musso | 173/17 |
| 4,479,551 | A | * | 10/1984 | Justus | 173/204 |
| 4,676,323 | A | * | 6/1987 | Henriksson | 173/200 |
| 4,784,228 | A | * | 11/1988 | Ito | 173/208 |
| 4,817,737 | A | * | 4/1989 | Hamada et al. | 173/115 |
| 4,899,836 | A | * | 2/1990 | Vernot | 173/207 |
| 5,064,005 | A | * | 11/1991 | Krone | 173/208 |
| 5,174,387 | A | * | 12/1992 | Arndt et al. | 173/1 |
| 5,653,295 | A | * | 8/1997 | Juvonen et al. | 173/208 |
| 5,718,297 | A | * | 2/1998 | Weber | 173/206 |
| 5,890,548 | A | * | 4/1999 | Juvonen | 173/208 |

* cited by examiner

*Primary Examiner*—Scott A. Smith
(74) *Attorney, Agent, or Firm*—Frishauf, Holtz, Goodman & Chick, P.C.

(57) ABSTRACT

A hydraulic impact mechanism includes a housing with a cylinder bore, a forward working chamber and a rear working chamber, a hydraulic fluid supply passage connected to the forward working chamber and a drain passage connected to the rear working chamber, a hammer piston reciprocally guided in the cylinder bore for delivering blows to a working implement attached to the housing, a pressure accumulator pre-loaded to a certain pressure level, and a distribution valve for alternatingly connecting the rear working chamber to the supply passage and the drain passage to thereby reciprocate the hammer piston, wherein a sequence valve is provided in the drain passage to keep up the pressure in the rear working chamber so that the resulting forward directed force prevents the piston from being moved backwards in the cylinder bore at pressure levels in the supply passage below the pre-load pressure level of the accumulator.

3 Claims, 2 Drawing Sheets

HYDRAULIC IMPACT MECHANISM

This application is a U.S. National Phase Application under 35 USC 371 of International Application PCT/SE2005/001230 filed Aug. 24, 2005.

The invention relates to a hydraulic impact mechanism of he type usually used in powerful breaking hammers which are supported by mechanical carries like excavator arms. In particular the impact mechanism according to the invention concerns a type of device which comprises a housing with a cylinder bore and a reciprocating hammer piston controlled by a distribution valve, and a pressure accumulator which is preloaded to a certain pre-load pressure level for boosting the performance of and protecting the mechanism against damaging pressure gradients and fluid cavities during operation.

A problem concerned with hydraulic impact mechanisms of this type is that the hammer piston easily starts operating before the pressure of the supplied hydraulic fluid has reached the same or higher level than the pre-load pressure of the accumulator, or continues to operate after the hydraulic supply pressure has dropped below the pre-load pressure level in the accumulator. This means that the accumulator is unable to operate as intended, i.e. absorbing undesirable pressure gradients, preventing cavities in the hydraulic fluid, and provide an increased fluid flow during the working stroke of the hammer piston. Accordingly, there is a considerable risk that damage will occur on certain parts of the impact mechanism.

The main object of the invention is to avoid the above problem by providing an impact mechanism which by a simple and non-expensive means guarantees that the hammer piston can not start operating until the pressure of the supplied hydraulic fluid exceeds the pre-load pressure level of the accumulator and will not continue to operate after the fluid pressure has dropped below the pre-load pressure level of the accumulator.

Further objects and advantages of the invention will appear from the following specification and claims.

Preferred embodiments of the invention are below described in detail with reference to the accompanying drawing.

IN THE DRAWING

Figure 1:
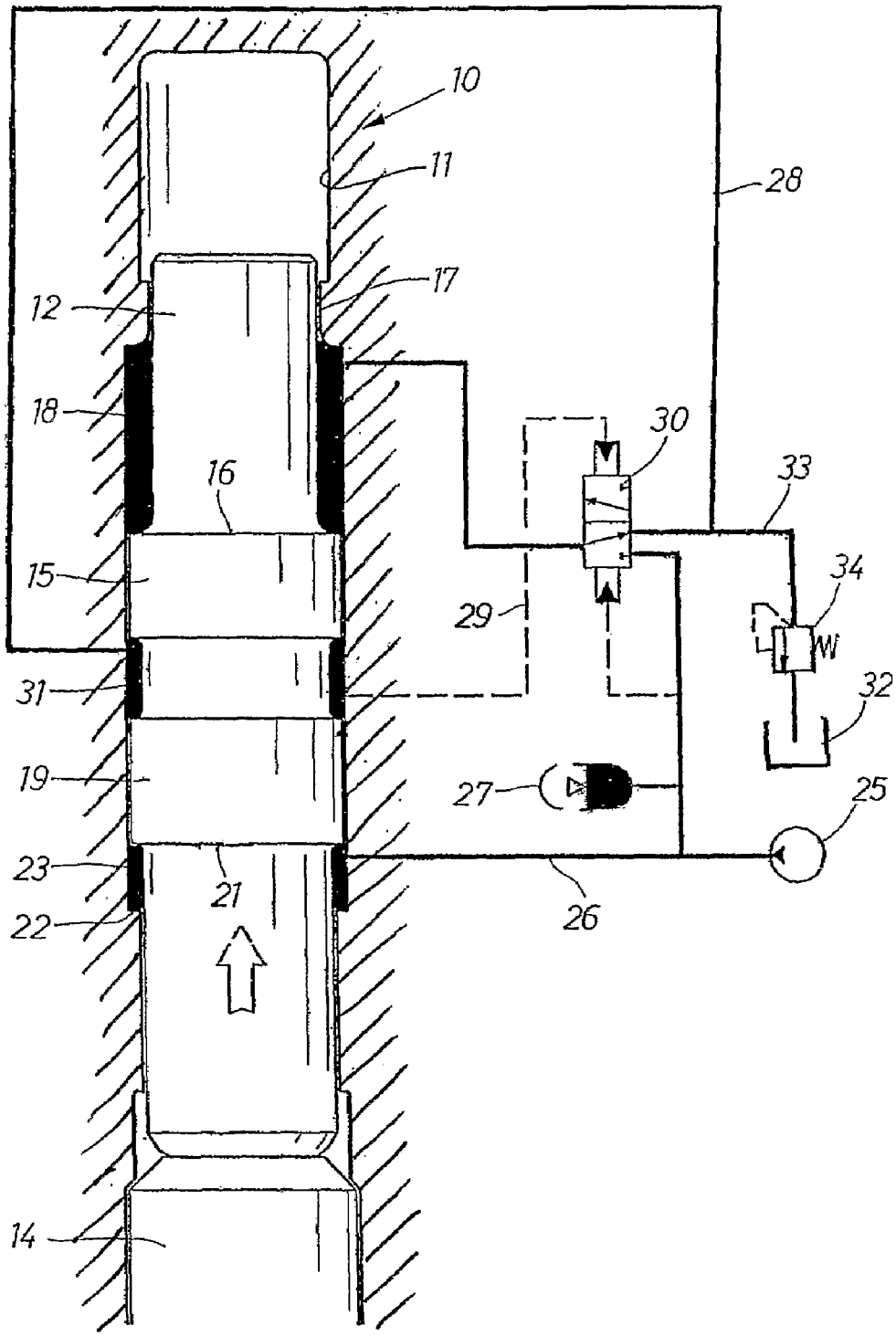
FIG. 1 shows schematically a hydraulic impact mechanism according to the invention.

The impact mechanism illustrated in FIG. 1 comprises a housing 10 with a cylinder bore 11 for guiding a reciprocating hammer piston 12. At its forward end the housing 10 has an opening co-axial with the cylinder bore 11 for receiving a working implement 14 to which the hammer piston 12 is intended to deliver repeated blows.

The hammer piston 12 has a rear guide portion 15 forming an annular rearwardly facing shoulder 16 which together with a waist portion 17 in the cylinder 11 forms a rear working chamber 18 intermittently pressurized for driving the piston 12 in the cylinder bore 11. The piston 11 also has a forward guide portion 19 formed with a forwardly facing shoulder 21 which together with a shoulder 22 in the cylinder bore 11 forms a forward working chamber 23. The latter is constantly connected to a pressure fluid source 25 via a fluid supply passage 26, and a pressure accumulator 27 connected to the forward working chamber via the supply passage 26 intended to prevent detrimental pressure gradients and cavitations in the fluid and to boost the power output of the impact mechanism. The accumulator 27 is pre-loaded to certain pressure level, and will not work as a pressure fluid expansion means in case the pressure of the hydraulic fluid supplied by the pressure fluid source 25 is below that pressure level.

A pressure fluid distribution valve 30 is connected to the rear working chamber 18 and to the pressure fluid source 25 so as to intermittently feed pressure fluid to the rear working chamber 18, and since the active pressurized area of the rearwardly facing shoulder 16 in the rear working chamber 18 is larger than that of the forwardly facing shoulder 21 in the forward working chamber 23 a pressurized rear working chamber 18 will exert a dominating force on the piston 12 and drive the latter forwards. A central drain chamber 31 is formed between the cylinder bore 11 and the two guide portions 15 and 19 of the piston 12 and is connected both to a tank 32 via a passage 28 and to one of the maneuver sides of the distribution valve 30 via a control passage 29 for repeated shifting of the valve 30 at operation of the hammer piston 12. The opposite maneuver side of the distribution valve 30 is continuously connected to the fluid supply passage 26.

Moreover, the distribution valve 30 as well as the rear working chamber 18 are connected to the tank 32 via a drain passage 33 and a sequence valve 34. The latter is intended to open up a communication with the tank 32 at pressure levels in the rear working chamber 18 exceeding a certain predetermined level only. The purpose of the sequence valve 34 is to create a minimum pressure level in the rear working chamber 18 such that a too low feed pressure in the supply passage 26 would not be able to accomplish reciprocation of the hammer piston 12. This is obtained by having the opening pressure of the sequence valve 34 adapted to the pre-load pressure of the accumulator 27 in such a way that the obtained minimum pressure in the rear working chamber 18 will always be high enough to prevent a supply pressure below the pre-load pressure of the accumulator 34 to move the piston 12 backwards in the cylinder bore 11. The reason is that if the hammer piston 12 were free to operate at pressure levels in the supply passage 26 which are below the pre-load pressure of the accumulator 27 the latter will not be able to operate as intended to prevent detrimental pressure gradients and cavitations in the fluid.

Since the central drain chamber 31 is connected to the sequence valve 34 via passage 28 and the drain passage 33 the pressure in the drain chamber 31 as well will be kept above the minimum pressure level. This means that the control pressure communicated to the distribution valve 30 via the control passage 29 is rather high, which in turn means that the pressure difference across the opposite maneuver sides of the distribution valve 30 is rather low. This results in a somewhat slower action of the distribution valve 30 and, hence, the hammer piston 12. On the positive side with this common fluid drainage through the sequence valve 34 is that the valve 34 can be located in the main outlet from the impact mechanism which means a simple mounting of and an easy access to the valve 34.

Figure 2:
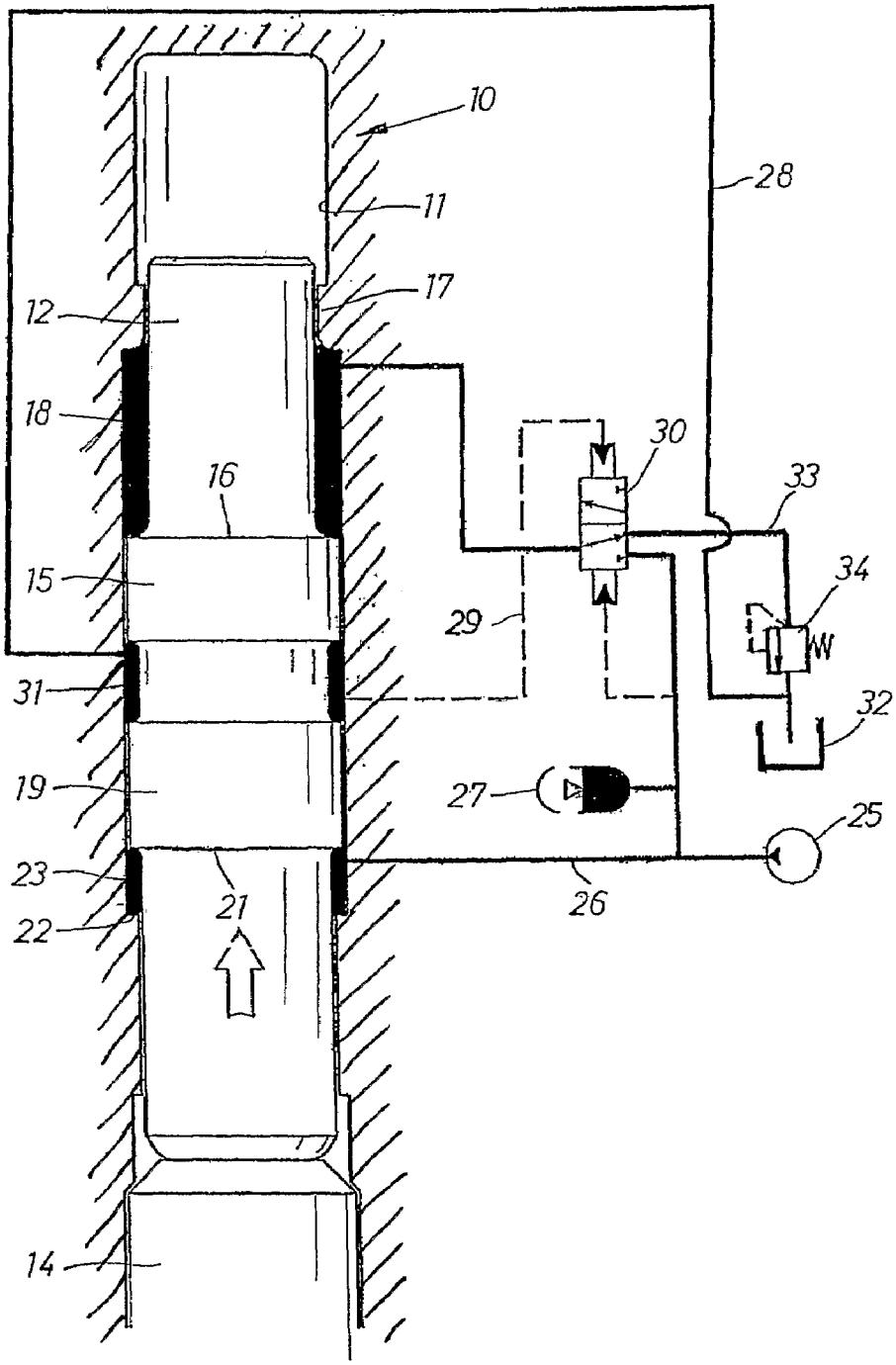
FIG. 2 shows schematically a hydraulic impact mechanism according to an alternative embodiment of the invention.

In order to get a faster action on the distribution valve 30 the central drain chamber 31 may be connected directly to the main outlet and to tank 32. This is illustrated in FIG. 2 as an alternative embodiment of the invention. In this case the sequence valve 34 is located in the drain passage 33 immediately downstream of the outlet port of the rear working chamber 18. This means that the central drain chamber 31 will be operated at a lower pressure and that the pressure difference between the opposite maneuver sides of the distribution valve 30 is higher. This results in a faster valve operation and, accordingly, a faster hammer piston operation. On the other hand, this causes a more complicated housing design and a reduced accessibility of the sequence valve 34 at service operations.

The invention claimed is:

1. A hydraulic impact mechanism comprising:

a housing having a hydraulic fluid supply passage, a drain passage, and a cylinder bore including a forward working chamber continuously communicating with the supply passage and a rear working chamber;

a hammer piston reciprocally guided in the cylinder bore;

a pressure accumulator pre-loaded to a certain pressure level and communicating with the forward working chamber;

a distribution valve which is arranged to alternatingly connect the rear working chamber to the supply passage and to the drain passage;

a sequence valve provided in the drain passage, said sequence valve having an opening pressure which is adapted to keep up the pressure in the rear working chamber to a level where a resulting force on the hammer piston prevents the hammer piston from moving rearwards at pressure levels in the supply passage below the pre-load pressure level of the accumulator.

2. The impact mechanism according to claim 1, comprising a central drain chamber arranged between said cylinder bore and the piston, said central drain chamber being arranged to provide a control pressure to said distribution valve and having an outlet passage connected to the drain passage upstream of said sequence valve.

3. The impact mechanism according to claim 1, comprising a central drain chamber arranged between said cylinder bore and the piston, said central drain chamber being arranged to provide a control pressure to said distribution valve and having an outlet passage connected to the drain passage downstream of said sequence valve.

* * * * *